US009343283B1

(12) United States Patent
Field et al.

(10) Patent No.: US 9,343,283 B1
(45) Date of Patent: May 17, 2016

(54) INTERNAL STANDARDIZATION WITH ENRICHED STABLE ISOTOPES AND COOL PLASMA ICPMS

(71) Applicant: Elemental Scientific, Inc., Omaha, NE (US)

(72) Inventors: Paul Field, Omaha, NE (US); Daniel R. Wiederin, Omaha, NE (US); Austin Schultz, Omaha, NE (US)

(73) Assignee: Elemental Scientific, Inc., Omaha, NE (US)

( * ) Notice: Subject to any disclaimer, the term of this patent is extended or adjusted under 35 U.S.C. 154(b) by 0 days.

(21) Appl. No.: 14/830,601

(22) Filed: Aug. 19, 2015

Related U.S. Application Data

(60) Provisional application No. 62/039,309, filed on Aug. 19, 2014.

(51) Int. Cl.
*H01J 49/10* (2006.01)
*H01J 49/00* (2006.01)
*H01J 49/04* (2006.01)

(52) U.S. Cl.
CPC ..... *H01J 49/105* (2013.01); *H01J 49/0031* (2013.01); *H01J 49/045* (2013.01)

(58) Field of Classification Search
USPC ..... 250/288, 282, 281, 423 R, 424
See application file for complete search history.

(56) References Cited

U.S. PATENT DOCUMENTS 6,974,951 B1 * 12/2005 Kingston ..... H01J 49/0031 250/281
2003/0013199 A1 * 1/2003 Anderson ..... G01N 1/16 422/62

* cited by examiner

*Primary Examiner* — Kiet T Nguyen
(74) *Attorney, Agent, or Firm* — Advent, LLP

(57) ABSTRACT

A method for internal standardization of cool plasma ICP-MS using one or more enriched stable isotopes includes introducing an enriched stable isotope of a chemical species to a sample containing a non-enriched isotope of the chemical species to form a sample and standard mixture. In implementations, the enriched stable isotope is introduced via an inline syringe addition to a flow of a sample solution containing a non-enriched isotope of the chemical species to be analyzed. The method also includes introducing the sample and standard mixture to an ICP-MS under cool plasma conditions. The method also includes determining an ionization amount of the enriched stable isotope by the ICP-MS. The method further includes correlating an ionization amount of the non-enriched isotope based on the determined ionization amount of the enriched stable isotope.

20 Claims, 1 Drawing Sheet

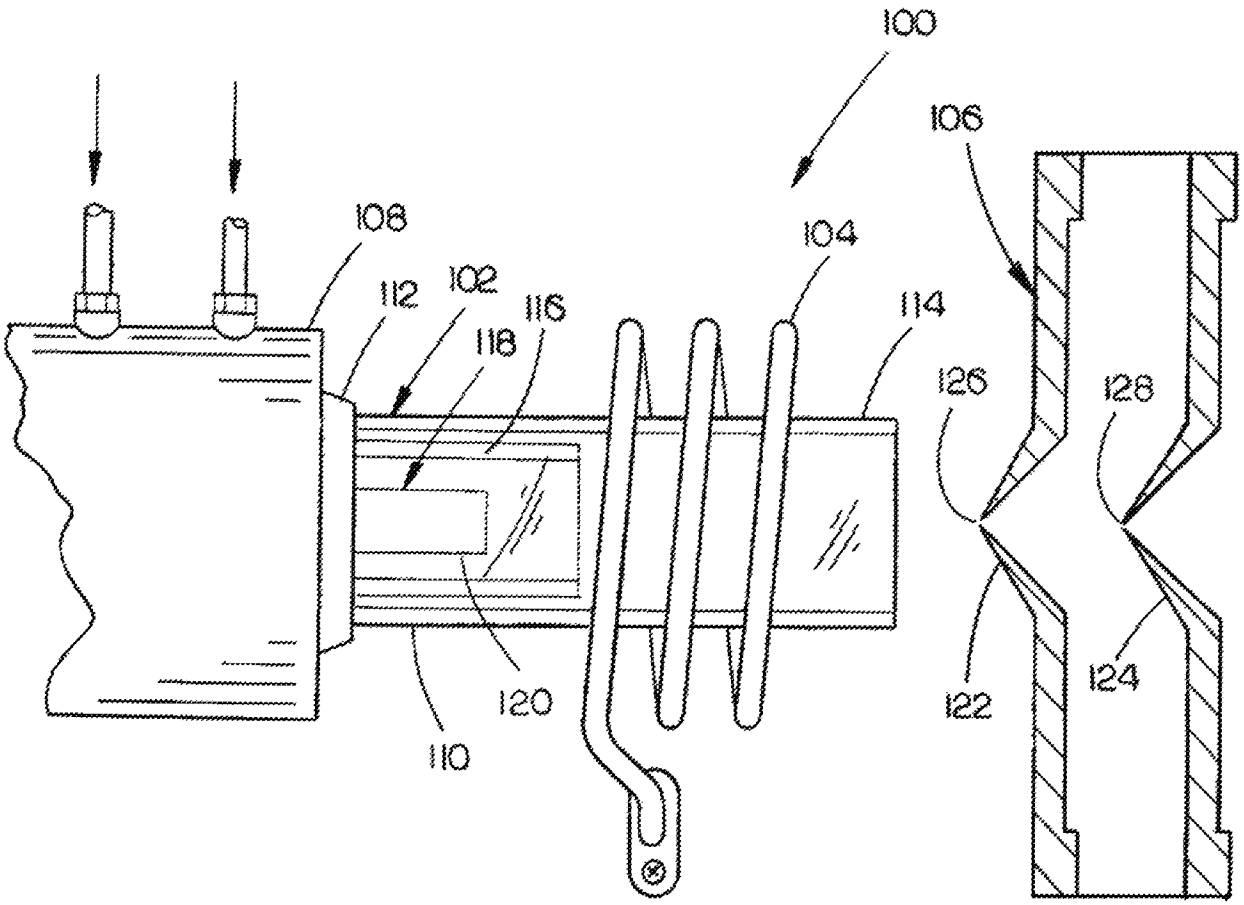
100
106
128
126
124
122
114
104
116
118
102
112
108
120
110

INTERNAL STANDARDIZATION WITH ENRICHED STABLE ISOTOPES AND COOL PLASMA ICPMS

CROSS-REFERENCE TO RELATED APPLICATIONS

The present application claims the benefit under 35 U.S.C. §119(e) of U.S. Provisional Application Ser. No. 62/039,309, filed Aug. 19, 2014, and titled "INTERNAL STANDARDIZATION WITH ENRICHED STABLE ISOTOPES AND COOL PLASMA ICPMS." U.S. Provisional Application Ser. No. 62/039,309 is herein incorporated by reference in its entirety.

BACKGROUND

Spectrometry refers to the measurement of radiation intensity as a function of wavelength to identify component parts of materials. Inductively Coupled Plasma (ICP) mass spectrometry is an analysis technique commonly used for the determination of trace element concentrations and isotope ratios in liquid samples. For example, in the semiconductor industry, ICP mass spectrometry can be used to determine metal concentrations in samples. ICP mass spectrometry employs electromagnetically generated partially ionized argon plasma which reaches a temperature of approximately 7,000K. When a sample is introduced to the plasma, the high temperature causes sample atoms to become ionized or emit light. Since each chemical element produces a characteristic mass spectrum, measuring the spectra of the emitted mass allows the determination of the elemental composition of the original sample. The sample to be analyzed is often provided in a sample mixture.

Sample introduction systems may be employed to introduce liquid samples into the ICP spectrometry instrumentation (e.g., an Inductively Coupled Plasma Mass Spectrometer (ICP/ICP-MS), an Inductively Coupled Plasma Atomic Emission Spectrometer (ICP-AES), or the like) for analysis. For example, a sample introduction system may withdraw an aliquot of a liquid sample from a container and thereafter transport the aliquot to a nebulizer that converts the aliquot into a polydisperse aerosol suitable for ionization in plasma by the ICP spectrometry instrumentation. The aerosol is then sorted in a spray chamber to remove the larger aerosol particles. Upon leaving the spray chamber, the aerosol is introduced into the plasma by a plasma torch assembly of the ICP-MS or ICP-AES instruments for analysis.

SUMMARY

A method for internal standardization of cool plasma ICP-MS using one or more enriched stable isotopes is described. The method includes introducing an enriched stable isotope of a chemical species to a sample containing a non-enriched isotope of the chemical species to form a sample and standard mixture. In implementations, the enriched stable isotope is introduced via an inline syringe addition to a flow of a sample solution containing a non-enriched isotope of the chemical species to be analyzed. The method also includes introducing the sample and standard mixture to an ICP-MS under cool plasma conditions. The method also includes determining an ionization amount of the enriched stable isotope by the ICP-MS. The method further includes correlating an ionization amount of the non-enriched isotope based on the determined ionization amount of the enriched stable isotope.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying FIGURES. In the FIGURES, the use of the same reference numbers in different instances in the description and the FIGURES may indicate similar or identical items.

FIG. 1 is an illustration of an ICP spectrometry system into which an internal standardization mixture is introduced in accordance with example implementations of the present disclosure.

DETAILED DESCRIPTION

Overview

At high temperatures, conventional or hot plasma conditions of ICP-MS facilitate total or near total ionization of a sample to be analyzed. However, such temperatures can introduce error or mischaracterization into the quantification of the associated elements of the sample. For instance, complete ionization of a sample containing $^{40}Ar$ (or $^{40}Ca^{+}$) and $^{16}O$ can provide an output peak at a mass-to-charge ratio (m/z) of about 56, which can provide a false indication of the presence of $Fe^{+}$, or provide an erroneous indication of the amount of $Fe^{+}$ actually present in the sample. Similarly, complete ionization of a sample containing $^{38}Ar$ and $^{1}H$ can provide an output peak at a mass-to-charge ratio (m/z) of about 39, which can provide a false indication of the presence of $K^{+}$, or provide an erroneous indication of the amount of $K^{+}$ actually present in the sample. High temperature plasma conditions can also cause degradation of portions of the sample introduction system, such as portions of an injector system or cone, which can contaminate the sample to be measured.

Cool plasma conditions can be utilized to avoid such error/mischaracterization and degradation by reducing the operating temperature of the ionizing plasma. However cool plasma conditions may not provide complete ionization of a sample. Further, introduction of some samples (e.g., samples including heavy metals, such as Nickel, Iron, and so forth, and associated ions) can cause a reduction in the plasma temperature, resulting in a transient cool plasma condition, which can affect ionization of the sample just prior to analysis in a mass spectrometer. For example, a sample having sodium ions ($Na^{+}$) may have approximately 100% of the sodium sample ionized under conventional hot plasma conditions. When under cool plasma conditions, the same sample may have approximately 30% of the sodium sample ionized. Further, when the sodium sample is introduced with additional constituent sample materials (e.g., hydrogen sulfide) and under cool plasma conditions, the sample may have approximately 15% of the sodium sample ionized. Such variance can be problematic for standardization techniques, since introducing a separate standard for testing can result in completely different ionization profiles between the standard and the sample, which can negatively influence quantification of the sample.

Accordingly, the present disclosure is directed to a method for internal standardization of cool plasma ICP-MS using one or more enriched stable isotopes. The method can include introducing an enriched stable isotope of a chemical species to a sample containing a non-enriched isotope of the chemical species to form a sample and standard mixture. The method also includes introducing the sample and standard mixture to an ICP-MS under cool plasma conditions. The method can also include determining an ionization amount of the enriched stable isotope by the ICP-MS. The method can also include correlating an ionization amount of the non-enriched isotope based on the determined ionization amount of the enriched stable isotope.

In the following discussion, example implementations of techniques for providing standardization in cool plasma ICP-MS using enriched stable isotopes are presented.

Example Implementations

FIG. 1 illustrates components of an ICP spectrometry system 100 in an example implementation. As shown, the ICP spectrometry system 100 comprises a plasma torch assembly 102, a radio frequency (RF) induction coil 104 that is coupled to an RF generator (not shown), and an interface 106. The plasma torch assembly 102 includes a housing 108 that receives a plasma torch 110 configured to sustain the ICP. The plasma torch 110 includes a torch body 112, a first (outer) tube 114, a second (intermediate) tube 116, and an injector assembly 118 which includes a third (injector) tube 120.

The plasma torch 110 is mounted horizontally by the housing 108 and positioned centrally in the RF induction coil 104 so that the end of the first (outer) tube 114 is adjacent to (e.g., 10-20 mm from) the interface 106. The interface 106 generally comprises a sampler cone 122 positioned adjacent to the ICP and a skimmer cone 124 positioned adjacent to the sampler cone 122, opposite the ICP. A small diameter opening 126, 128 is formed in each cone 122, 124 at the apex of the cone 122, 124 to allow the passage of ions from the ICP for analysis.

A flow of gas (e.g., the plasma-forming gas), which is used to form the ICP, is passed between the first (outer) tube 114 and the second (intermediate) tube 116. A second flow of gas (e.g., the auxiliary gas) is passed between the second (intermediate) tube 116 and the third (injector) tube 120 of the injector assembly 118. The second flow of gas is used to change the position of the base of the ICP relative to the ends of the second (intermediate) tube 116 and the third (injector) tube 120. In typical implementations, the plasma-forming gas and the auxiliary gas comprise argon (Ar). However, it is contemplated that other gases may be used instead of or in addition to argon (Ar), in specific implementations.

The RF induction coil 104 surrounds the first (outer) tube 114 of the plasma torch 110. RF power (e.g., 750-1500 W) is applied to the coil 104 to generate an alternating current within the coil 104. Oscillation of this alternating current (typically 27 or 40 MHz) causes an electromagnetic field to be created in the plasma-forming gas within the first (outer) tube 114 of the plasma torch 110 to form an ICP discharge through inductive coupling.

A carrier gas is then introduced into the third (injector) tube 120 of the injector assembly 118. The carrier gas passes through the center of the plasma, where it forms a channel that is cooler than the surrounding plasma. Samples to be analyzed are introduced into the carrier gas for transport into the plasma region, usually as an aerosol of liquid formed by passing the liquid sample into a nebulizer. As a droplet of nebulized sample enters the central channel of the ICP, it evaporates and any solids that were dissolved in the liquid vaporize and then break down into atoms. In typical implementations, the carrier gas may comprise argon (Ar). However, it is contemplated that other gases may be used instead of, or in addition to, argon (Ar) in specific implementations.

The ICP spectrometry system 100 can be operated under cool plasma conditions, which are facilitated by the RF power applied to the coil 104 and/or by the flow rate of the carrier gas. For example, cool plasma operation can involve an RF power of less than 900 W with a carrier gas flow sufficient to suppress formation of carrier gas ions. In implementations, cool plasma operation can involve an RF power of between 400 W and 900 W. However, it is noted that the flow rate of the carrier gas can influence whether the RF power applied to the coil 104 would facilitate cool plasma operation (e.g., at high carrier gas flow rates, a higher RF power can be applied to the coil 104 while maintaining cool plasma conditions). During cool plasma operation of the ICP spectrometry system 100, an internal standardization technique can be utilized to account for less than total ionization of sample constituents. For example, standardization of cool plasma ICP-MS can be accomplished using one or more enriched stable isotopes for standardization of non-enriched isotopes included in a sample. In implementations, the method includes introducing an enriched stable isotope of a chemical species to a sample containing a non-enriched isotope of the chemical species to form a sample and standard mixture. The enriched stable isotope is dependent upon the particular non-enriched isotope to be measured. For example, where the non-enriched isotope to be measured is $^{60}$Ni, the enriched stable isotope can be $^{61}$Ni. As another example, where the non-enriched isotope to be measured is $^{56}$Fe, the enriched stable isotope can be $^{57}$Fe. The enriched stable isotopes are generally affected by the cool plasma conditions to the same effect as the non-enriched isotopes, and thus, the ionization amount of the standard and the sample are at least approximately the same. In implementations, a substantially pure (e.g., at 99.9% by weight) standard is utilized to avoid substantial contamination of the sample isotope to be measured. For example, in the case of an enriched stable isotope of $^{61}$Ni, a 99.9% pure standard in an amount of 10 ppt (parts per trillion) can contribute less than 0.01 ppt to the measurement of the non-enriched isotope to be measured ($^{60}$Ni). In implementations, the enriched stable isotopes are introduced via inline syringe addition to a flow of a sample solution containing a non-enriched isotope of the chemical species to be analyzed. For example, a syringe pump can pump the enriched stable isotope from a source of the enriched stable isotope (e.g., from a substantially pure scientific standard solution) to a flow of the sample solution, such as through a controlled inline introduction (e.g., via one or more valve assemblies) where the enriched stable isotope is introduced inline to the sample solution. In implementations, a flow of an enriched stable isotope solution is introduced inline to a flow of the sample containing the non-enriched isotope of the chemical species to be analyzed. The inline introduction can be facilitated by independent peristaltic pumps used to drive the flow of the enriched stable isotope solution and the flow of the non-enriched isotope of the chemical species to be analyzed. The inline introduction can be facilitated by syringe pumps used to drive the flow of the enriched stable isotope solution and the flow of the non-enriched isotope of the chemical species to be analyzed. In implementations, the inline addition of the enriched stable isotope provides controlled inline dilution of the sample solution containing the non-enriched isotope of the chemical species to be analyzed. Such inline introduction can mitigate or prevent contamination to the sample to be analyzed that could occur during non-inline mixing procedures.

The method also includes introducing the sample and standard mixture to an ICP-MS under cool plasma conditions. For example, a 99.9% standard of $^{61}$Ni is mixed with a sample containing $^{60}$Ni, and the mixture is introduced to the ICP spectrometry system 100. The method also includes determining an ionization amount of the enriched stable isotope by the ICP-MS. For example, an ionization amount of the $^{61}$Ni is determined based on the known amount of $^{61}$Ni introduced to the system 100 and based on the output data of the system 100. The method further includes correlating an ionization amount of the non-enriched isotope based on the determined ionization amount of the enriched stable isotope. Since the enriched stable isotopes are generally affected by the cool plasma conditions to the same effect as the non-enriched isotopes, the ionization amount of the standard can be similarly attributed to an otherwise unknown ionization amount of the sample. For example, an ionization amount of the $^{60}$Ni can be correlated to the known ionization amount of $^{61}$Ni introduced to the system 100, where the amount of $^{60}$Ni present in the sample can be determined based on the output data of the system 100, the correlated ionization amount, and any impurities present in the standard $^{61}$Ni. For example, where an ionization amount of 30% is determined for the $^{61}$Ni introduced to the system 100 under cool plasma conditions, an ionization amount of 30% can be correlated to the $^{60}$Ni present in the sample. The amount of $^{60}$Ni actually present in the sample can then be determined, for example, based on the m/z value returned from the analysis of the sample and the 30% ionization amount. In implementations, the amount of the non-enriched isotopes can be determined based on the correlated ionization amount and based on analysis of the non-enriched isotope, which can include analysis of the non-enriched isotope without the added non-enriched isotopes (e.g., a separate analysis from the analysis used to determine the ionization amount of the enriched isotope as part of the sample and standard mixture). For example, signals from the analysis of the sample and standard mixture can be subtracted by signals from the analysis of the sample separately, while taking into consideration the correlated ionization amount.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A method comprising:

introducing an enriched stable isotope of a chemical species to a sample containing a non-enriched isotope of the chemical species to form a sample and standard mixture;

introducing the sample and standard mixture to an inductively coupled plasma mass spectrometer (ICP-MS) under cool plasma conditions;

determining an ionization amount of the enriched stable isotope by the ICP-MS; and correlating an ionization amount of the non-enriched isotope based on the determined ionization amount of the enriched stable isotope.

2. The method of claim 1, wherein introducing the enriched stable isotope of the chemical species to the sample containing the non-enriched isotope of the chemical species includes introducing a flow of a solution of enriched stable isotope inline to a flow of the sample containing the non-enriched isotope of the chemical species.

3. The method of claim 2, wherein the flow of the solution of enriched stable isotope and the flow of the sample containing the non-enriched isotope are driven by independent peristaltic pumps.

4. The method of claim 2, wherein the flow of the solution of enriched stable isotope and the flow of the sample containing the non-enriched isotope are driven by syringe pumps.

5. The method of claim 1, wherein the enriched stable isotope is a substantially pure enriched stable isotope.

6. The method of claim 1, wherein the cool plasma conditions include operating the ICP-MS with a supplied radio frequency (RF) power from about 900 W to about 400 W.

7. The method of claim 6, wherein the cool plasma conditions include operating the ICP-MS with a carrier gas flow rate configured to suppress formation of carrier gas ions.

8. The method of claim 1, further comprising:

determining an amount of the non-enriched isotope of the chemical species.

9. The method of claim 8, wherein the amount of the non-enriched isotope of the chemical species is determined based on one or more of the correlated ionization amount, an m/z value associated with the non-enriched isotope determined by the ICP-MS, and an amount of impurity associated with the enriched stable isotope of the chemical species.

10. The method of claim 1, wherein the non-enriched isotope of the chemical species includes $^{60}$Ni, and wherein the enriched stable isotope includes $^{61}$Ni.

11. The method of claim 1, wherein the non-enriched isotope of the chemical species includes $^{56}$Fe, and wherein the enriched stable isotope includes $^{57}$Fe.

12. A method comprising:

introducing an enriched stable isotope of a chemical species via inline addition to a flow of a sample containing a non-enriched isotope of the chemical species to form a flow of a sample and standard mixture;

introducing the flow of the sample and standard mixture to an inductively coupled plasma mass spectrometer (ICP-MS) under cool plasma conditions;

determining an ionization amount of the enriched stable isotope by the ICP-MS; and correlating an ionization amount of the non-enriched isotope based on the determined ionization amount of the enriched stable isotope.

13. The method of claim 12, wherein introducing the enriched stable isotope of the chemical species via inline addition to the flow of the sample containing the non-enriched isotope of the chemical species includes introducing, via syringe pump, the enriched stable isotope of the chemical species to the flow of the sample containing the non-enriched isotope of the chemical species.

14. The method of claim 12, wherein the enriched stable isotope is a substantially pure enriched stable isotope.

15. The method of claim 12, wherein the cool plasma conditions include operating the ICP-MS with a supplied radio frequency (RF) power from about 900 W to about 400 W.

16. The method of claim 15, wherein the cool plasma conditions include operating the ICP-MS with a carrier gas flow rate configured to suppress formation of carrier gas ions.

17. The method of claim 12, further comprising:

determining an amount of the non-enriched isotope of the chemical species.

18. The method of claim 17, wherein the amount of the non-enriched isotope of the chemical species is determined based on one or more of the correlated ionization amount, an m/z value associated with the non-enriched isotope determined by the ICP-MS, and an amount of impurity associated with the enriched stable isotope of the chemical species.

19. The method of claim 12, wherein the non-enriched isotope of the chemical species includes $^{60}$Ni, and wherein the enriched stable isotope includes $^{61}$Ni.

20. The method of claim 12, wherein the non-enriched isotope of the chemical species includes $^{56}Fe$, and wherein the enriched stable isotope includes $^{57}Fe$.

* * * * *